US007267563B2

(12) United States Patent
Stowers et al.

(10) Patent No.: US 7,267,563 B2
(45) Date of Patent: Sep. 11, 2007

(54) DUAL ENGAGEMENT LEVER INTERFACE

(75) Inventors: Jeffrey P. Stowers, Mt. Sidney, VA (US); David L. Rocker, Charlottesville, VA (US); Randall Herron, Waynesboro, VA (US); Eric Hubbard, Fishersville, VA (US)

(73) Assignee: Virginia Panel Corporation, Waynesboro, VA (US)

( * ) Notice: Subject to any disclaimer, the term of this patent is extended or adjusted under 35 U.S.C. 154(b) by 0 days.

(21) Appl. No.: 11/075,165

(22) Filed: Mar. 8, 2005

(65) Prior Publication Data

US 2006/0205253 A1 Sep. 14, 2006

(51) Int. Cl.
*H01R 13/62* (2006.01)

(52) U.S. Cl. ..... 439/157

(58) Field of Classification Search ..... 439/157, 439/136, 51, 851, 341, 355; 324/761
See application file for complete search history.

(56) References Cited

U.S. PATENT DOCUMENTS

| | | | | |
|---|---|---|---|---|
| 4,212,508 | A | 7/1980 | Cline et al. | |
| 4,213,666 | A | 7/1980 | Braginetz et al. | |
| 4,313,150 | A * | 1/1982 | Chu | 361/755 |
| 4,329,005 | A | 5/1982 | Braginetz et al. | |
| 4,402,563 | A * | 9/1983 | Sinclair | 439/264 |
| 4,556,268 | A * | 12/1985 | Noschese | 439/267 |
| 4,628,413 | A * | 12/1986 | Speraw | 361/798 |
| 5,108,298 | A * | 4/1992 | Simmel | 439/157 |
| 5,139,430 | A * | 8/1992 | Lewis et al. | 439/157 |
| 5,140,501 | A * | 8/1992 | Takahashi et al. | 361/798 |
| 5,227,718 | A | 7/1993 | Stowers et al. | |
| 5,317,480 | A * | 5/1994 | Chandraiah et al. | 361/785 |
| 5,320,544 | A * | 6/1994 | Naoto et al. | 439/157 |
| 5,389,000 | A * | 2/1995 | DiViesti et al. | 439/157 |
| 5,420,519 | A | 5/1995 | Stowers et al. | |
| 5,576,631 | A | 11/1996 | Stowers et al. | |
| 5,633,597 | A | 5/1997 | Stowers et al. | |
| 5,801,926 | A * | 9/1998 | Cutsforth et al. | 361/754 |
| 5,850,147 | A | 12/1998 | Stowers et al. | |
| 5,936,421 | A | 8/1999 | Stowers et al. | |
| 5,942,906 | A | 8/1999 | Stowers et al. | |
| 5,966,023 | A | 10/1999 | Burgers et al. | |
| 6,419,499 | B1 * | 7/2002 | Bundza | 439/61 |
| 6,824,405 | B2 | 11/2004 | Hubbard et al. | |
| 6,869,321 | B1 | 3/2005 | Ashby et al. | |
| 6,872,006 | B2 | 3/2005 | Langouet et al. | |
| 6,882,138 | B2 | 4/2005 | Langouet et al. | |
| 6,948,952 | B2 | 9/2005 | Hubbard et al. | |
| 2004/0077198 | A1 * | 4/2004 | Schlack | 439/160 |

* cited by examiner

*Primary Examiner*—Chandrika Prasad
(74) *Attorney, Agent, or Firm*—24IP Law Group USA; Timothy R. DeWitt

(57) ABSTRACT

A mass interconnect device having a receiver and test adapter, each having a plurality of modules, pins and patch-cords connected thereto. The receiver has an independent rotatable engagement lever attached at each side for drawing a test adapter into engagement with the receiver. Each engagement lever has dual cams that mate with a slot in an engagement plate on each side of the test adapter, thereby permitting the pair to provide four-point pull-down of the test adapter into the receiver.

19 Claims, 8 Drawing Sheets

DUAL ENGAGEMENT LEVER INTERFACE

CROSS-REFERENCE TO RELATED APPLICATIONS

None.

STATEMENT REGARDING FEDERALLY SPONSORED RESEARCH OR DEVELOPMENT

Not applicable.

FIELD OF THE INVENTION

The invention relates broadly to an interface connection system and, more specifically, to a low-cost engagement system with floating interconnects. Such connection interface equipment requires the frequent placement of interchangeable test adapters (ITA) or wiring modules with multiple minute electrical contacts in operative engagement with opposite co-acting electrical contacts of, for example, receiver modules. The receiver contacts and interchangeable test adapter/wiring contacts should engage with precision to minimize wear and to prevent damaging the delicate and expensive equipment.

BACKGROUND OF THE INVENTION

A variety of mass interconnect devices have been used in the past. One example of prior art interface systems was disclosed in U.S. Pat. No. 4,329,005, entitled "Slide Cam Mechanism for Positioning Test Adapter in Operative Relationship with a Receiver," which was assigned to Virginia Panel Corporation. In the '005 patent, the receiver included an inner frame and outer walls. Between the outer walls and adjacent sides of the receiver frame were placed fixed hanger plates provided with straight slots and interior slides having coacting cam slots. The slides were driven by a hand lever and attached round torsion shaft with connected linkage having an over-dead-center locked position. Movement of the hand lever would cause the slides to move parallel to the outer walls and interior sides. Modules for holding various electrical contacts were mounted in the receiver parallel to the direction of movement of the slides.

The individual test adapter, or ITA, had four split roller dual bearings or rollers on common dry lube sleeves that would rotate oppositely during the camming action to minimize friction. The individual test adapter rollers rested on dwell shoulders of the cam slots and then descended through the straight slots during movement of the slides of the receiver to produce positive straight-on engagement of the test adapter and receiver multiple contacts. The slides had elongated linear guide bearings with dry lube pads for precision free movement. The slides were connected to a cylindrical torsion shaft via linkage. Like the receiver modules, the ITA modules were mounted in the system in a direction parallel to the ITA sides on which the rollers were located. When modules, pins, patchcords, and perhaps a cover are mounted to or on the interface test adapter, the assembly is sometimes referred to as a "fixture."

Another prior art system has been known as the MAC Panel Series 06, or rotating latch, interface device. In the rotating latch type device, the camming is performed by plates that rotate rather than moving in a linear fashion. In the rotating latch devices, the connector modules have been mounted to the receiver and test adapter frame parallel to the plant of rotation of the rotating latches.

Another prior art system sold by Virginia Panel Corporation included a receiver that included slides similar to those disclosed in the '005 patent but used pins at two corners, diagonal from one other, on the receiver. These pins inhibited vertical movement of the ITA in the receiver to produce straight-on engagement. This prior art system included machined side rails and a cylindrical torsion shaft.

Another prior interface device is known as the TTI Testron VG Series interface device. This device may be in a tabletop or a rack-mounted form. This VG Series device included a fixture support plate mounted to the receiver in a direction perpendicular to the face of the receiver. The receiver would be mounted directly to the test equipment.

The TTI Testron fixture, or test adapter, would be engaged to the receiver by lifting the fixture onto a pair of hooks protruding from the face of the receiver and then resting the fixture on the support plate. A handle and gears were used to pull the hooks, and hence, the fixture, into the receiver to cause the electrical contacts in the receiver and the fixture to mate.

Yet another prior art test system was used prior to 1980 in connection with the federal government's F-16 program. That system had a slide plate on each side of the receiver, with each slide plate connecting to the engagement pins on the sides of a corresponding ITA frame and each slide plate being pulled into the receiver via a connection near the center of the slide plate. This system suffered from significant problems of the ITA tilting to some degree and thereby causing contacts to be crushed.

Although these devices generally functioned well and provided advantages over prior devices, the devices did not provide users with a low-cost interface device for use with relatively small numbers of modules and contacts. Further, the devices included many components, including some machined parts, which contributed to expense and increased time for manufacturing and assembling the products.

SUMMARY OF THE INVENTION

In a preferred embodiment, the present invention is an interface connection system or mass interconnect device has a receiver and test adapter, each having a plurality of modules, pins and patchcords connected thereto. The receiver has an independent rotatable engagement lever attached at each side for drawing a test adapter or ITA into engagement with the receiver. Each engagement lever has dual cams or camming arms that mate with a slot in an engagement plate on each side of the test adapter, thereby permitting the dual cams to provide four-point pull-down of the test adapter into the receiver.

In another embodiment, the interface device of the present invention has a receiver comprised of a receiver frame having two pairs of opposing sides, a rotation member on each of one pair of opposing sides of the receiver frame, an engagement lever mounted to each of the rotation members. Each engagement lever has a pair of spaced engagement members. The interface further has a test adapter having a frame with two pairs of opposing sides and an engagement surface on each of one of those pairs of opposing sides. During engagement of the test adapter into the receiver, a pair of the engagement members on at least one of the engagement levers simultaneously align with and exert a force on an engagement surface of the test adapter.

The engagement lever may further comprise a body having a first and second ends and first and second sides with the spaced engagement members being located on the first side near the first end and a connection member for connecting the engagement lever to the rotation member, the connection member being located on the second side near the first end. The engagement lever further may have a grip on one or both sides near the second end.

The receiver frame may further comprise an alignment pin near at least one of the rotation members, and the test adapter frame further comprise means for receiving the alignment pin. The alignment pin may comprise a polarized tooling pin.

One or more modules may be mounted to the receiver frame, and floating contacts placed in the module. Likewise, one or more modules may be mounted in the test adapter frame in a position or positions corresponding to the positions of the modules in the receiver frame. Floating contacts may be mounted into corresponding positions in the modules in the receiver and test adapter.

In another embodiment, a receiver according to the invention has a receiver frame with two pairs of opposing sides, a rotation block mounted to each of one pair of opposing sides of said receiver frame, an engagement lever mounted to each of said rotation blocks and a means for mounting the engagement levers to the rotation blocks. The engagement levers each comprise a lever body having first and second ends and first and second sides, a pair of spaced engagement arms on a first side of the lever body near the first end of the lever body. The rotation blocks may further comprise an alignment groove and/or a polarizing groove. A rotation block in accordance with the present invention may further comprise a latch pin to which a latch on an engagement lever connects to provide a positive locking latch feature.

An embodiment of a test adapter according to the invention has a frame comprising two pairs of opposing sides and an engagement plate mounted to each of one pair of opposing sides of the frame. Each said engagement plate comprises an engagement plate body, a plurality of mounting holes in the engagement plate body for mounting the engagement plate body to the test adapter frame; and an engagement slot in the engagement plate body. The engagement plates each may further have an alignment ridge that aligns with an alignment groove in the receiver when test adapter is engaged in the receiver and/or a polarizing ridge and mates with a polarizing groove in the corresponding rotation block on the receiver. Each engagement plate further may have a latch plate onto which a latch on an engagement lever of a receiver can lock the test adapter into the receiver after engagement.

In another embodiment, an interface of the invention comprises a receiver having a frame with two pairs of opposing sides, a pair of engagement levers each having dual camming surfaces; and means for mounting each of the engagement levers to a side of the receiver frame. The interface further comprises a test adapter having a frame with first and second pairs of opposing sides and means on each of the first pair of sides of the test adapter frame for engaging with the dual camming surfaces of one of the engagement levers. During engagement of the test adapter into the receiver, the dual camming surfaces of at least one of the engagement levers align with and exert a force on at least one of the means for engaging of the test adapter.

Still other aspects, features, and advantages of the present invention are readily apparent from the following detailed description, simply by illustrating preferable embodiments and implementations. The present invention is also capable of other and different embodiments, and its several details can be modified in various respects, all without departing from the spirit and scope of the present invention. Accordingly, the drawings and descriptions are to be regarded as illustration in nature, and not as restrictive.

BRIEF DESCRIPTION OF THE DRAWINGS

The invention of the present application will now be described in more detail with reference to preferred embodiments of the architecture and method, given only by way of example, and with reference to the accompanying drawings, in which:

FIG. 2(*b*) is a profile view of the positive locking latch feature of an embodiment of the present invention.

DESCRIPTION OF THE PREFERRED EMBODIMENTS

Figure 1:
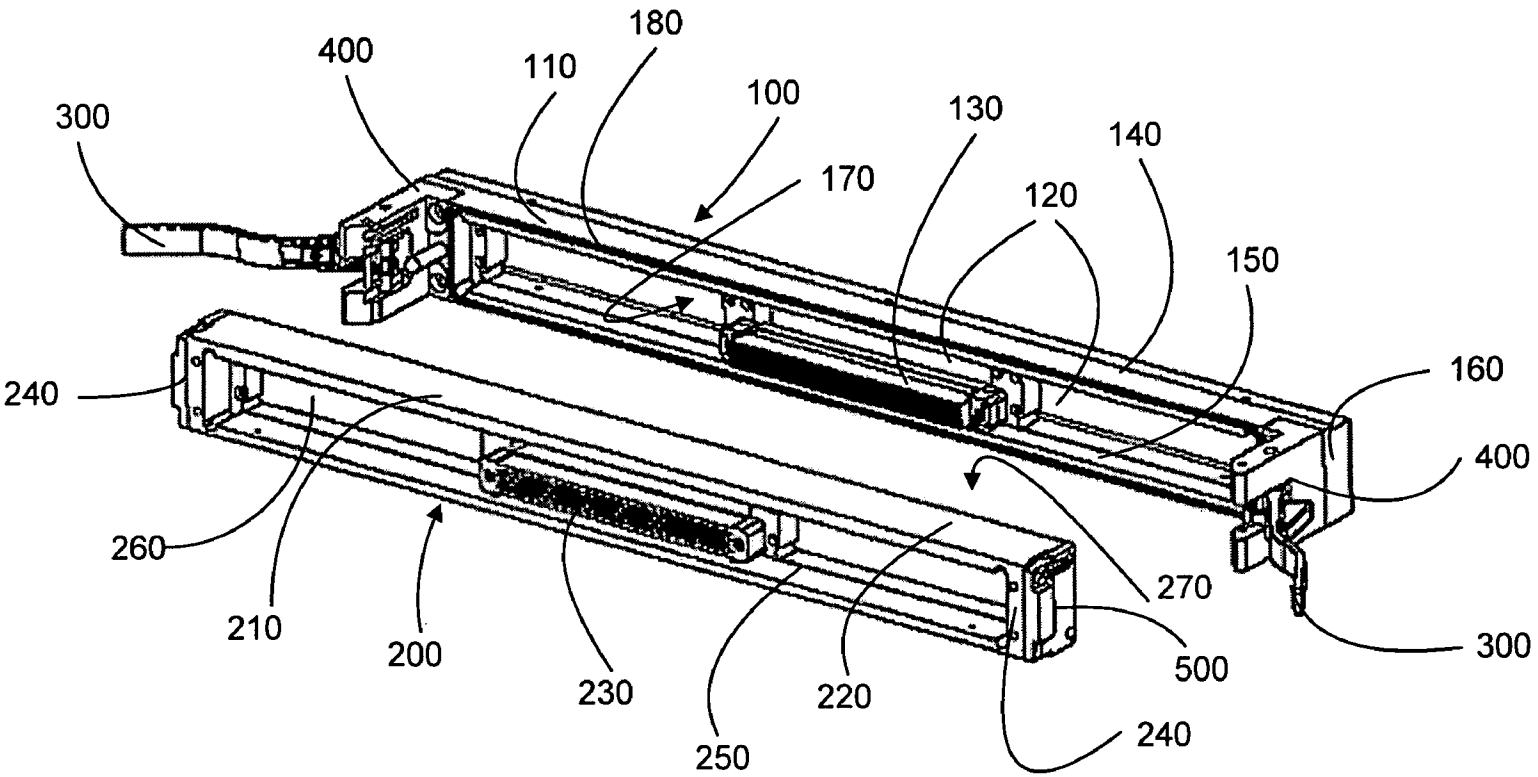
FIG. 1 is a perspective view of a mass interconnect device in accordance with an embodiment of the present invention.

A mass interconnect device or interface device in accordance with a preferred embodiment of the invention will be described with reference to FIGS. 1–5. The interface device has a receiver 100 and a test adapter 200.

The receiver 100 had a frame 110 having one or more openings 120 therein for receiving modules 130. In a preferred embodiment, the receiver frame 110 has three openings 120, each of which can receive two modules 130. The receiver frame in the preferred embodiment thus may receive a total of six modules. While six modules are used in this preferred embodiment, other arrangements of the receiver frame to accommodate other numbers of modules may be used with the present invention and will be apparent to those of skill in the art. The modules 130 are connected to receiver frame 110 via any of a variety of conventional means such as by screws that are placed into module mounting holes 102.

The receiver frame 110 has a top 140, a bottom 150, and two sides 160, that form a face 170. The top, bottom and sides of the face 170 have an RF gasket 180 for EMI shielding of the receiver. At each side of the face 170, the receiver frame has a tooling pin 190 that prevents improper engagement of the test adapter to the receiver and hold the test adapter upon disengagement. The tooling pin 190 also may align the test adapter with the receiver for engagement. The receiver frame 110 has a mounting or rotation block 400 connected to each side and an engagement lever 300 connected to each mounting block 400. In FIG. 1, the lever 300 is shown in a unlatched position.

The test adapter or ITA 200 has a frame 210 having a top 220, a bottom 250, and a pair of sides 240 that form a face 270. The test adapter face 270 has a plurality of openings 260 therein for receiving modules 230 that hold contacts. The modules 230 connect to the test adapter frame via conventional means such as screws and are arranged to match the arrangement of modules in the receiver. An engagement plate 500 is secured to each side 240 of the ITA frame via conventional means such as by screws.

The receiver and test adapter modules hold "floating" contacts (not shown) such as those disclosed and described in U.S. patent application Ser. No. 10/608,144, filed on Jun. 30, 2003 and entitled "Dual Female Electrical Connector and Connector Module," which is hereby incorporated by reference herein in its entirety. Such floating contacts permit movement of the contacts during engagement and thereby prevent damage to the contacts due to minor misalignments of the receiver and test adapter during engagement.

Figure 2A:
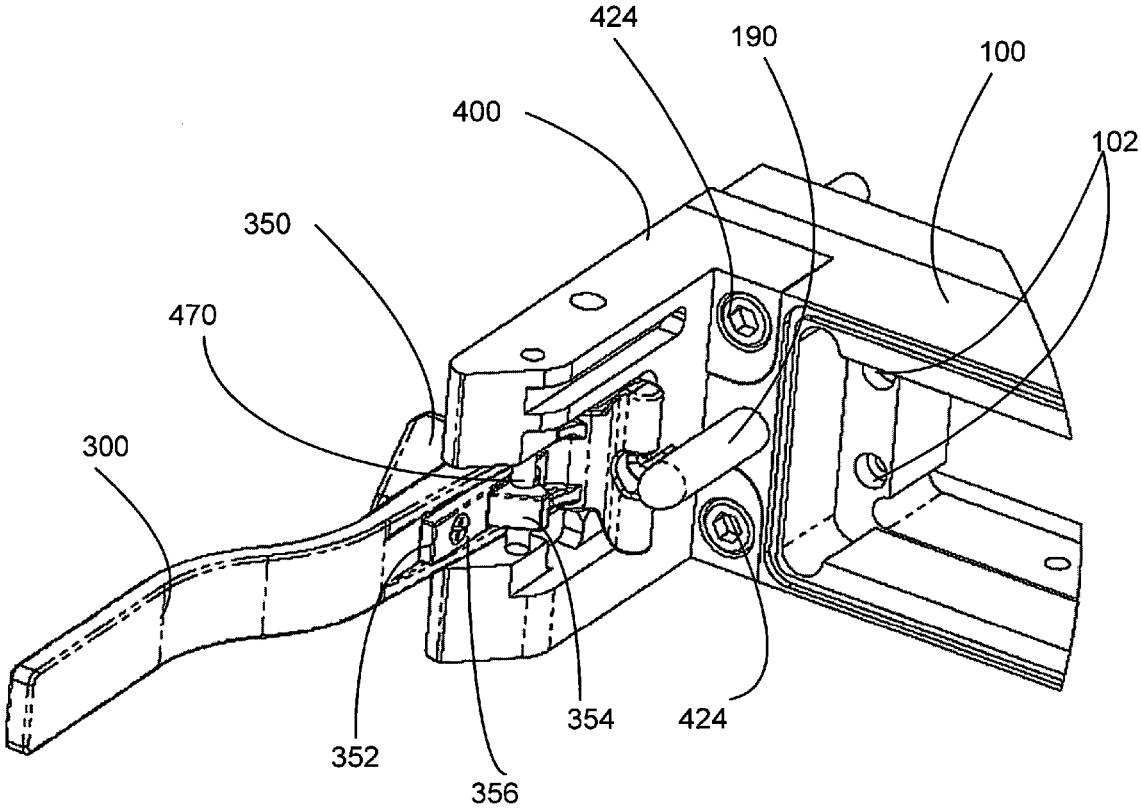
FIG. 2(*a*) is a profile view of an engagement mechanism of a receiver in accordance with a preferred embodiment of the present invention.
Figure 2B:
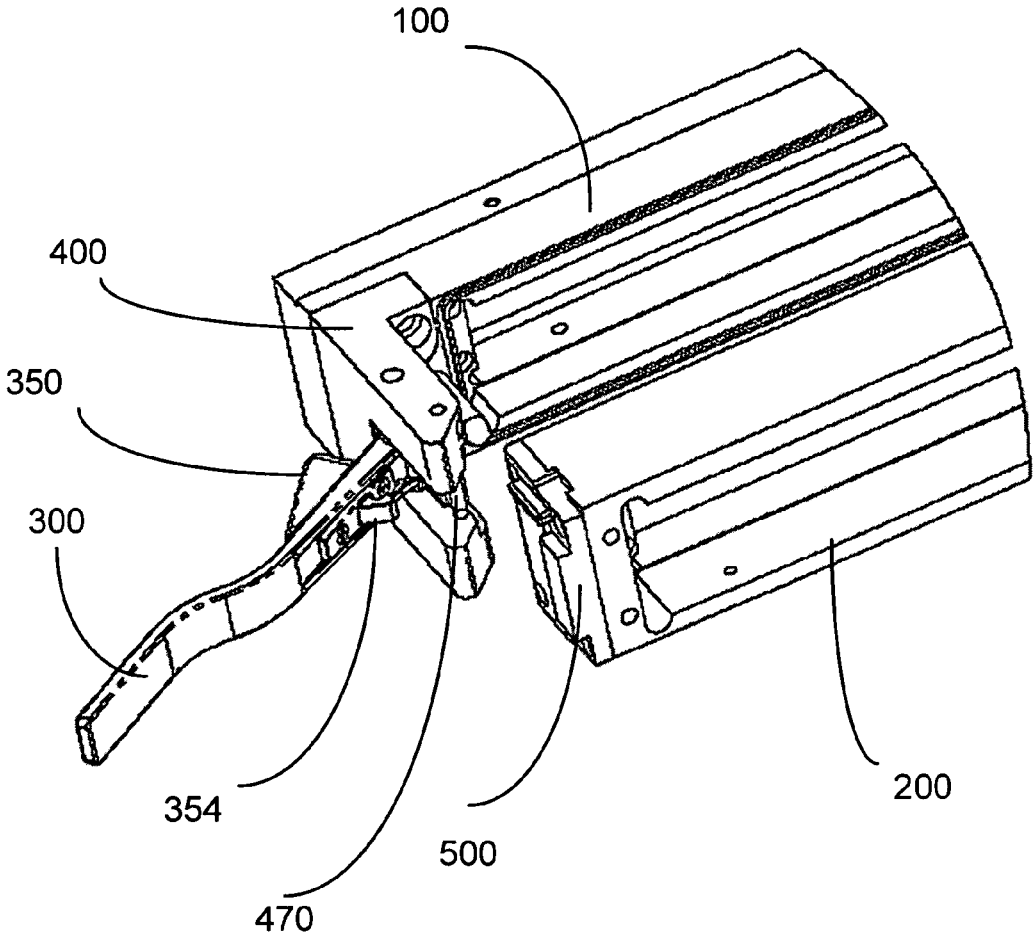
Figure 3B:
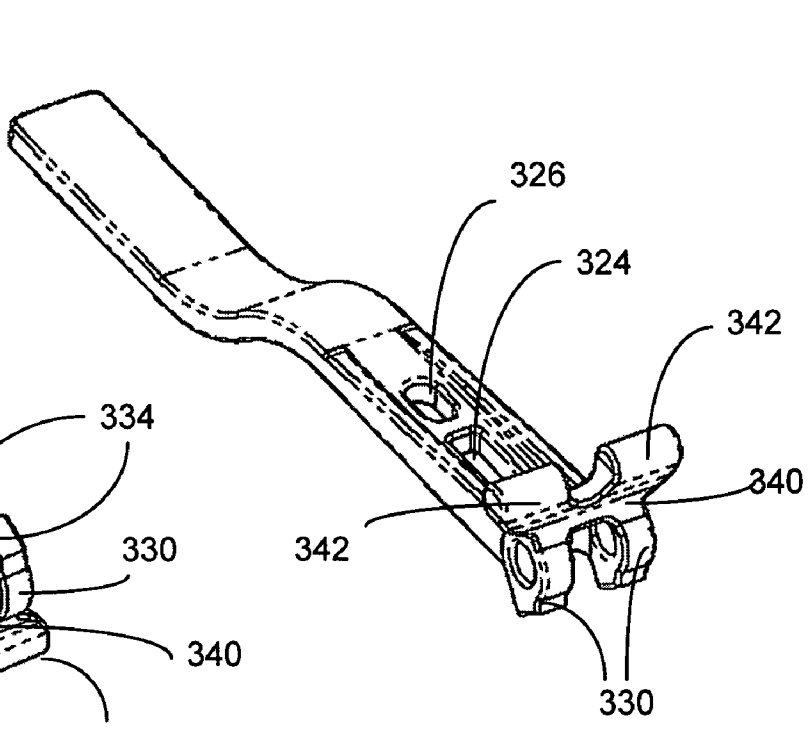
FIGS. 3(*a*) and (*b*) are front and back perspective views of an engagement lever of an embodiment of the present invention.
Figure 3A:
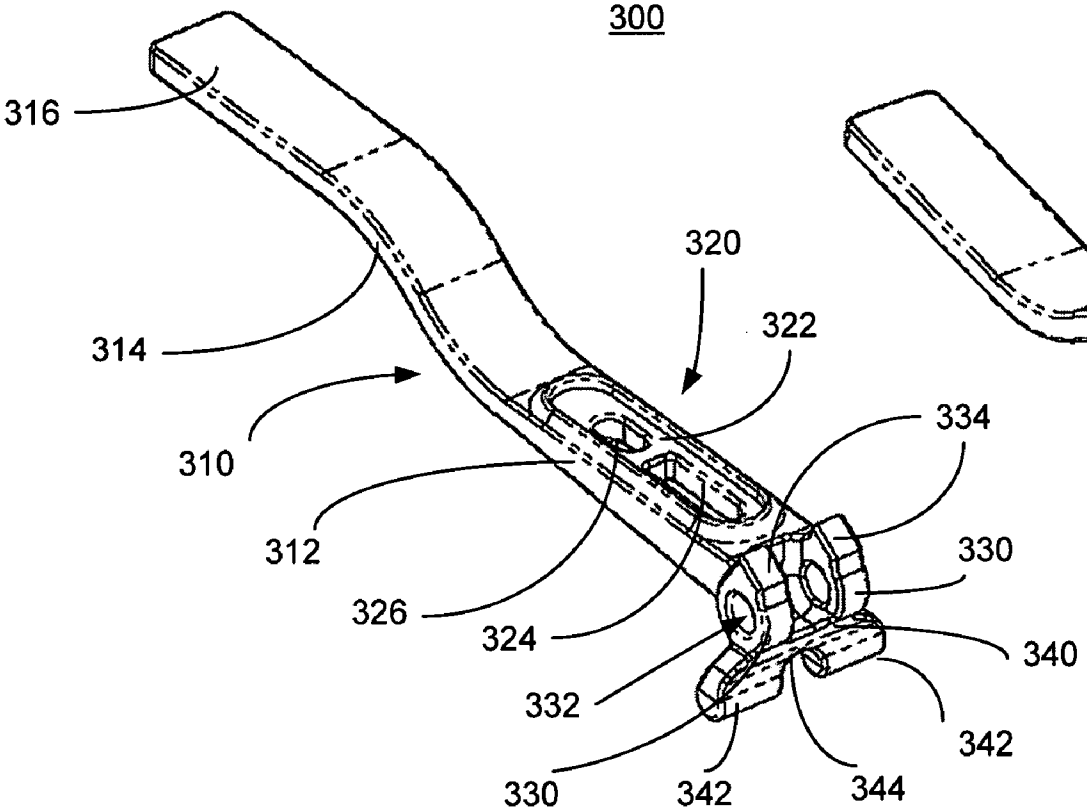

The engagement lever 300 is shown in more detail in FIGS. 2(*a*)–(*b*) and 3(*a*)–(*b*). The engagement lever 300 has an elongated flat body 310 having an inner portion 312 and an outer portion 316 with a contoured portion 314 in-between. When the engagement lever 300 is in place and is in a latched state after test adapter 200 has been engaged to receiver 100, the inner portion 312 of the engagement lever 300 will be near the receiver frame 110 and the outer portion 316 will be spaced away from the receiver frame 110 and test adapter frame 210 to permit the lever 300 to be grasped by a user to disengage the test adapter 200 from the receiver 100.

The inner portion 312 of the engagement lever 300 has a latch mounting portion 320 therein for receiving a latch 350 as shown in FIGS. 2(*a*) and (*b*). In a preferred embodiment, the latch mounting portion 320 has a recess 322 on one side and a two holes 324, 326 in the recess 322 for mounting a latch mechanism 350 to the engagement lever 300.

Near the end 340 of the inner portion 312 of the engagement lever 300, a pair of connection arms 330 is located such that they extend approximately perpendicular to the inner body 312 in a direction that will be away from the receiver frame 100 when the lever is in a latched position. Each connection arm 330 has a hole 332 for receiving a pin or dowel (not shown) for connecting the engagement lever 300 to the rotation block 400 and permitting the engagement lever 300 to rotate relative to the rotation block 400. Each connection arm 330 further has a stop surface 334 for limiting rotation of the engagement lever 300 in one direction.

Near the end 340 of the engagement lever 300, a pair of engagement or camming arms 342 extend in a direction opposite the connection arms 330. The camming arms 342 have a space 344 between them for aligning the camming arms 342 with the tooling pin 190 when test adapter 200 is engaged with the receiver 100. While in this preferred embodiment the camming arms 342 extend in a direction opposite the connection arms 330, other arrangements of the connection arms or connection means and camming arms or means will be readily apparent to those of ordinary skill in the art and may be used with the present invention. Likewise, while camming arms are use in this preferred embodiment, other camming mechanisms or means may be used with the invention.

In this embodiment, the latch mechanism 350 is mounted to the engagement lever 300 via two screws 356 placed through a plate 354, through holes 324, 326 in the engagement lever and into the latch mechanism 354. A latching portion 354 extends through hole 324, which is elongated in this embodiment. The latching portion 354 hooks onto dowel or pin 470 in the rotation block when the engagement lever 300 is in a closed position. Various latching mechanisms are known in the art and may be used with the present invention.

Figure 4:
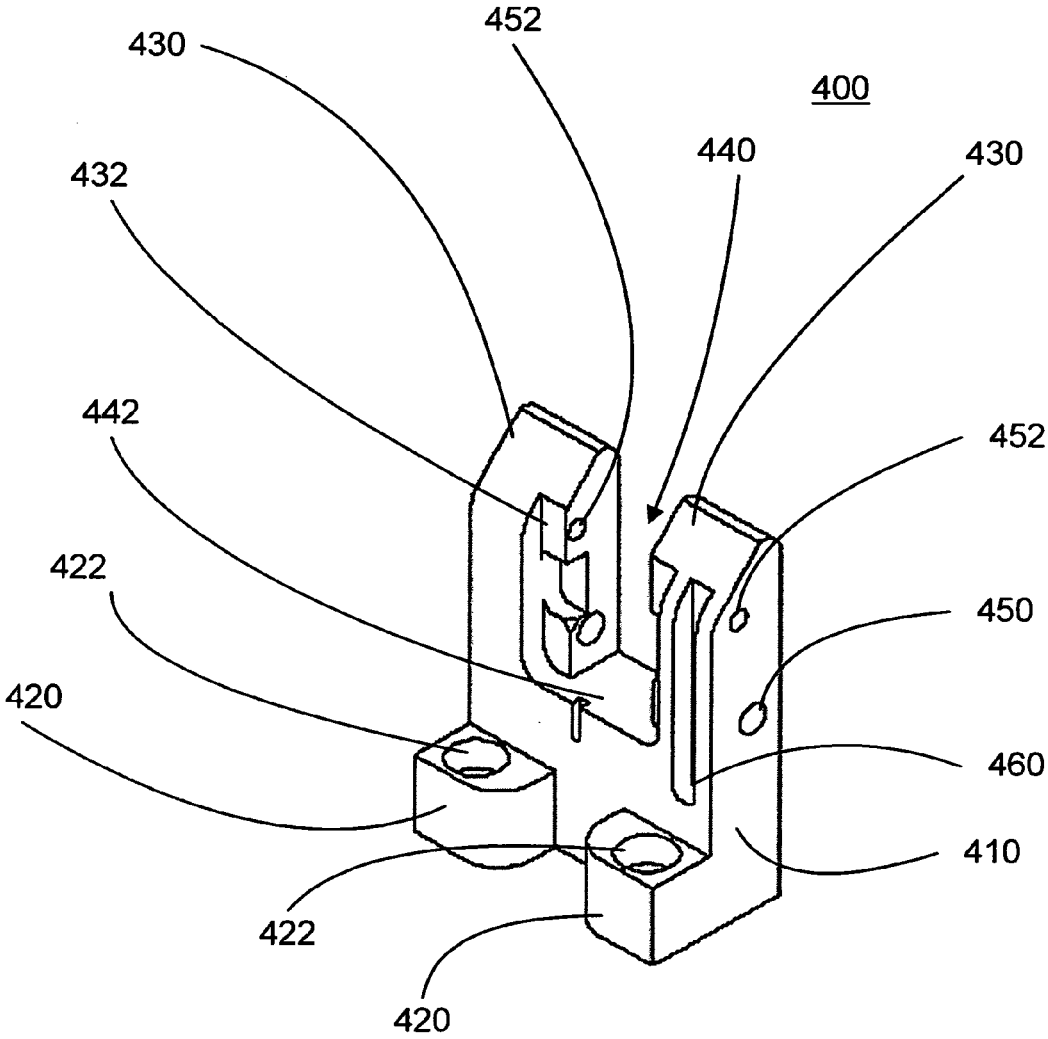
FIG. 4 is a perspective view of a rotation block of a receiver in an embodiment of the present invention.

The rotation block 400 of a preferred embodiment will be described in more detail with reference to FIG. 4. The rotation block 400 has a base 410 having two mounting arms 420, each having a mounting hole 422 for mounting the rotation block 400 to the receiver frame 110 using screws (not shown). The receiver side 160 in the preferred embodiment has a recess (not shown) into which the rotation block 400 is mounted, thus leaving a flush surface on the side of the receiver 100. The receiver frame 110 likewise has recesses for receiving the mounting arms 420 of the rotation block 400. Screws 424 are placed through the mounting holes 422 to secure the rotation or mounting block 400 to the receiver 100. Other arrangements for mounting the rotation or mounting block to the receiver frame will be apparent and may be used with the present invention.

The rotation block 400 further has two arms 430 that extend out from the face 170 of the receiver 110. Between the arms 430 is a slot or opening 440. Near the base 442 of the slot 440 there is a hole 450 through the arm 430 for receiving a pin (not shown). The engagement lever 300 is mounted in the slot 440 by placing the arms 330 of the engagement lever 300 into the slot 440 and placing a pin (not shown) through hole 450 in one rotation block arm 430, through the holes 332 in the engagement lever and through the hole 450 in the other rotation block arm 430. The arm 430 in the rotation block 400 further has a hole 452 for receiving a dowel pin onto which the latch 354 connects when the engagement lever 300 is in a closed position to provide a locking latch function or feature. A lip 432 extends into the slot 440 from each arm 430. One of the arms 430 has a polarizing groove 460 for receiving a polarizing ridge 512 on the engagement plate 500. In an alternative embodiment, the groove 460 and ridge 512 may be adapted to provide an alignment function in addition to or instead of a polarizing function.

While the rotation block or member 400 of the preferred embodiment is formed as a separate part that is mounted to the receiver frame 110, in other embodiment a rotation block or member or means may be formed integral with the side of the receiver frame.

The engagement plate 500 will be described with reference to FIGS. 5(*a*) and (*b*). The engagement plate 500 has a body 510 having four spaced apart screw holes 520 for mounting the engagement plate to the side 240 of the test adapter frame 210. While four screw holes 520 in this embodiment are located near four corners of the engagement plate 500, other numbers of mounting screw holes, locations for such screw holes, and mounting arrangement will be apparent to those of skill in the art and may be used with the present invention.

The engagement plate 500 further has an engagement slot 530 for receiving the camming arms 342 of the engagement lever 300 during engagement of a test adapter 200 into a receiver 100. In this preferred embodiment, the engagement slot 530 is elongated and has beveled corners 532. Other shapes and structures of an engagement slot will be apparent to those of skill in the art and may be used in the invention, including the provision of separate holes or slots for receiving the camming arms 342 of the engagement lever 300. The engagement slot 530 provides a lower surface 534 onto which the camming arms of the engagement lever exert force to pull or push the test adapter into the receiver. The engagement slot further provides an upper surface 536 onto which the camming arms of the engagement lever 300 exert force to disengage the test adapter from the receiver. Thus, the slot serves both engagement and disengagement purposes in this embodiment. While the surfaces 534 and 536 are referred to as "lower" and "upper," it should be understood that the interface of the present invention may placed in a variety of positions such that the surface may better be referred to as "engagement" and "disengagement" surfaces.

Further, while an engagement plate and slot are used in this embodiment, other embodiments in which an engagement surfaces of some type other than a slot may be used. For example, an engagement surface could be machined into the side of the test adapter frame 210 as an engagement member.

At the top and bottom of the engagement slot 530 are arched portions 560, 570. The arched portions 560, 570 align with an arched portion (not shown) formed in the test adapter frame 210 to form an alignment hole (not shown) through which the tooling pins 190 protrude from the face of the receiver prior to and during engagement. The engagement plate further has a polarizing ridge 512 protruding therefrom for polarizing the engagement plate 500 with the rotation block 400 during engagement.

Figure 5A:
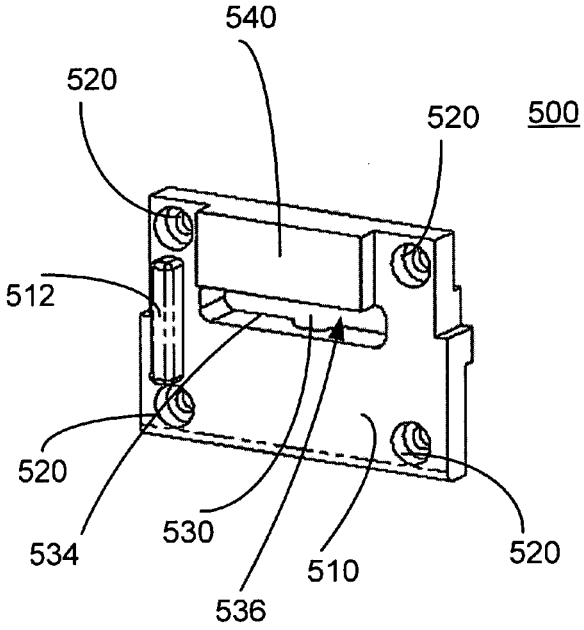
FIGS. 5(*a*) and (*b*) are front and back perspective views of an engagement plate of a test adapter in accordance with an embodiment of the present invention.
Figure 5B:
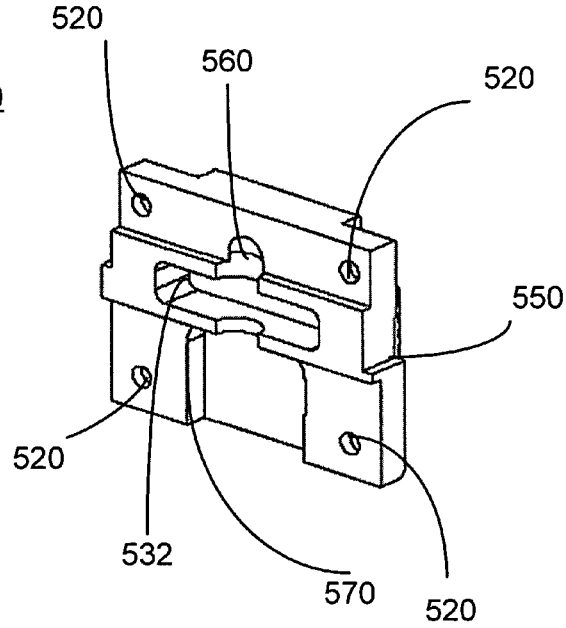

Each engagement plate 500 has a block 540 located adjacent (above in FIG. 5(*a*)) the slot 530. The block 540 creates a surface on the side of the block 540 adjacent the slot 530 that assists in the engagement of the ITA 200 into the receiver 100 as described below.

To engage the test adapter 200 with the receiver 100, the test adapter 200 is placed next to the receiver 100 such that the tooling pin 190 on each side of the receiver 100 is aligned with the corresponding arched portion 260 in the test adapter frame 210 and the polarizing ridge 512 of one engagement plate 500 aligns with the corresponding polarizing groove 460 of one rotation block 400. As the test adapter 200 is manually pushed toward the receiver 100, the block 540 on the engagement plate comes into contact the camming arms 342 of the engagement lever 300, thus causing the engagement lever 300 to begin rotating about the pin or dowel (not shown) in the rotation block 400. This ensures that the lever is in the correct position to create mechanical advantage to achieve final engagement of the test adapter 200 in the receiver 100. This surface on the block 540 also provides for mechanical advantage by the engagement lever 300 when disengaging the test adapter 200 from the receiver 100.

The engagement lever 300 on each side of the receiver is rotated with the outer body 316 away from the receiver frame 110 to what may be referred to as the "open" position. The test adapter 200 is then moved toward the face 170 of the receiver 100 to a point at which the camming arms 342 of each engagement lever 300 on the receiver 100 will align with the engagement slot 530 on the engagement plate 500 on the corresponding side of the test adapter frame 210. The engagement levers are then closed, either one at a time or simultaneously. When each engagement lever 300 is rotated such that the outer body 316 moves toward the receiver frame 110 to what may be referred to as a "closed" position, the camming arms 342 exert a force against the bottom of the engagement slot 530 thereby causing that side of the test adapter frame to move into the face 170 of the receiver frame 110. The use of two camming arms on each side of the test adapter creates a "four-point pull-down" effect that limits tilting of the test adapter during alignment and thereby prevents damage to the floating contacts used with the invention.

As that side of the test adapter frame 210 moves into the face of the receiver, the polarizing ridge 512 of the engagement plate on that side of the receiver moves into the polarizing groove 460 in the rotation block. Each engagement lever 300 is rotated until the latch 350 latches onto the latch pin 470 in the rotation block 400.

In past interface devices have relatively large numbers of contacts, it has been necessary to cam both sides of a test adapter into a receiver simultaneously to prevent misalignment and damage to the contacts. With the present invention, however, independent closing or latching of each side of the test adapter into the receiver is accomplished by limiting the degree of misalignment to within the tolerances made possible by the floating contacts used with the present invention.

Figure 6B:
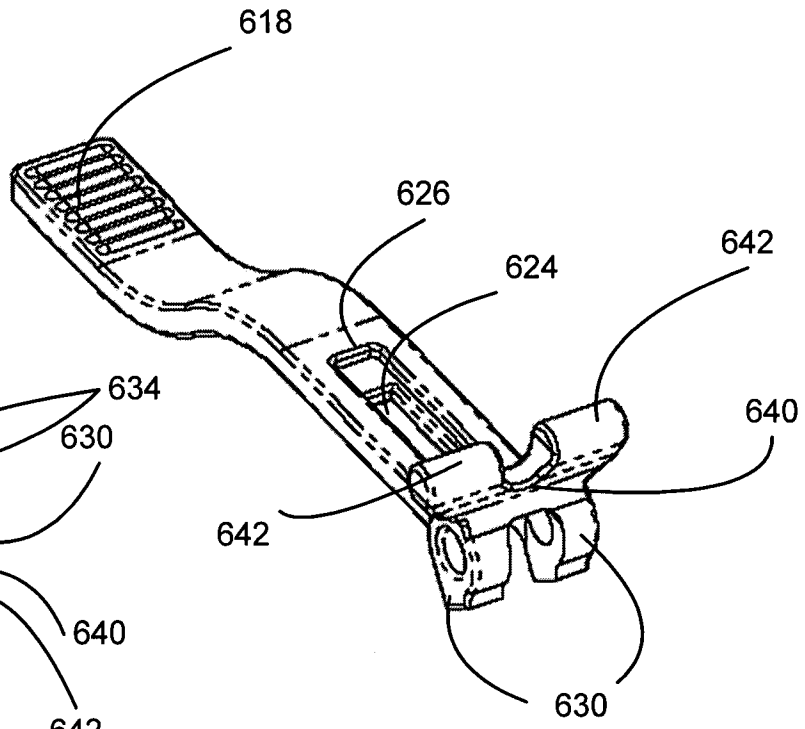
FIGS. 6(*a*) and (*b*) are front and back perspective views of an engagement lever of an alternative embodiment of the present invention.
Figure 6A:
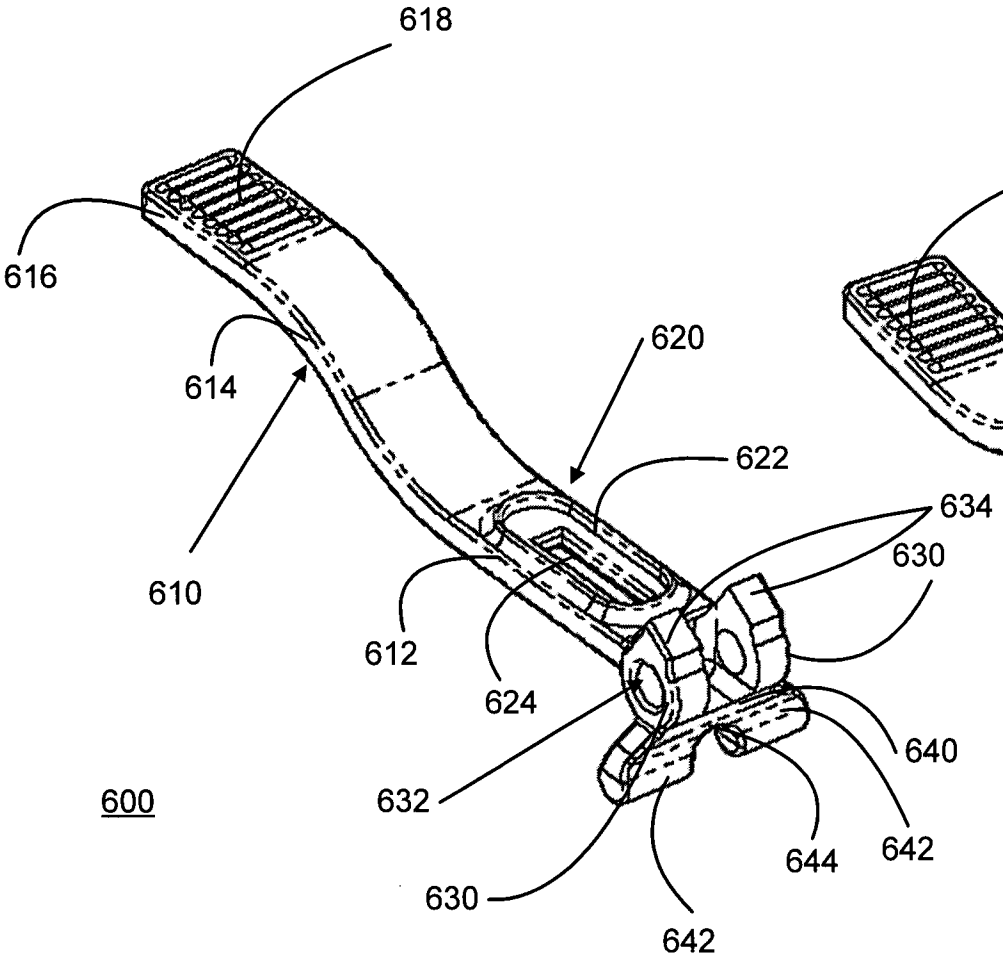

An alternative embodiment of the engagement lever is shown in more detail in FIGS. 6(*a*) and (*b*). The engagement lever 600 has an elongated flat body 610 having an inner portion 612 and an outer portion 616 with a contoured portion 614 in-between. When the engagement lever 600 is in place and is in a latched state after test adapter 200 has been engaged to receiver 100, the inner portion 612 of the engagement lever 600 will be near the receiver frame 110 and the outer portion 616 will be spaced away from the receiver frame 110 and test adapter frame 210 to permit the lever 600 to be grasped by a user to disengage the test adapter 200 from the receiver 100.

On the outer portion 616 is a grip or means for gripping 618 such as ridges, bumps, or dimples to facilitate gripping of that portion by a user's fingers. The grip preferably is located on both sides of the engagement lever and may be formed integral with the engagement lever or may be added to the engagement lever as a coating or adhesive.

The inner portion 612 of the engagement lever 600 has a hole 620 therein for receiving a latch (not shown). In a preferred embodiment, the latch hole 620 has a recess 622 on one side for receiving the latch release mechanism (not shown) and a recess 626 on an opposing side for accommodating the latch.

Near the end 640 of the inner portion 612 of the engagement lever 600, a pair of connection arms 630 is located such that they extend approximately perpendicular to the inner body 612 in a direction that will be away from the receiver frame 100 when the lever 600 is in a latched position. Each connection arm 630 has a hole 634 for receiving a pin or dowel (not shown) for connecting the engagement lever to a rotation block and permitting the engagement lever 600 to rotate relative to the rotation block. Each connection arm further has a stop surface 634 for limiting rotation of the engagement lever in one direction.

Near the end 640 of the engagement lever 600, a pair of engagement or camming arms 642 extend in a direction opposite the connection arms 630. The camming arms 642 have a space 644 between them for aligning the camming arms 642 with the tooling pin 190 when test adapter 200 is engaged with the receiver 100.

Figure 7:
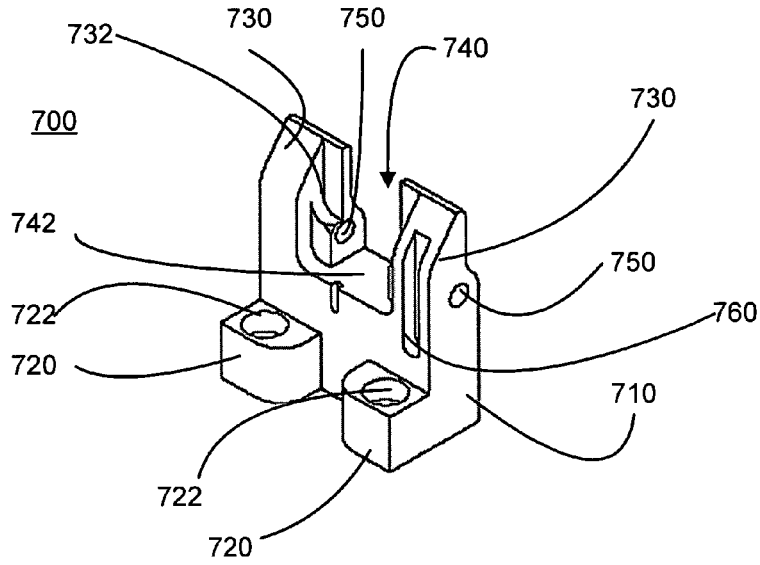
FIG. 7 is a perspective view of a rotation block of a receiver in an alternative embodiment of the present invention.

An alternative embodiment of the rotation block 700 will be described in more detail with reference to FIG. 7. The rotation block has a base 710 having two mounting arms 720, each having a mounting hole 722 for mounting the rotation block to the receiver frame 110 using screws (not shown). The receiver side 160 in the preferred embodiment has a recess into which the rotation block 700 is mounted, thus leaving a flush surface on the side of the receiver 100. The receiver frame 110 likewise has recesses for receiving the mounting arms 720 of the rotation block 700.

The rotation block 700 further has two arms 730 that extend out from the face 170 of the receiver 100. Between the arms 730 is a slot 740. Near the base 742 of the slot 740 there is a hole 750 through the arm 730 for receiving a pin or dowel (not shown). The engagement lever 600 is mounted in the slot by placing the arms 630 of the engagement lever 600 into the slot 740 and placing a pin (not shown) through hole 750 in one rotation block arm 730, through the holes 632 in the engagement lever and through the hole 750 in the other rotation block arm 630. A lip 732 extends into the slot 740 from each arm 730. One of the arms 730 has a groove 760 for receiving an alignment ridge 512 on the engagement plate 500. While the holes 750 are round in this embodiment, other shapes, such as oval, square, hexagon, octagon, triangle, etc. may be used with the present invention.

While the rotation block or member 700 of the preferred embodiment is formed as a separate part that is mounted to the receiver frame 110, in other embodiment a rotation block or member or means may be formed integral with the side of the receiver frame.

Figure 8A:
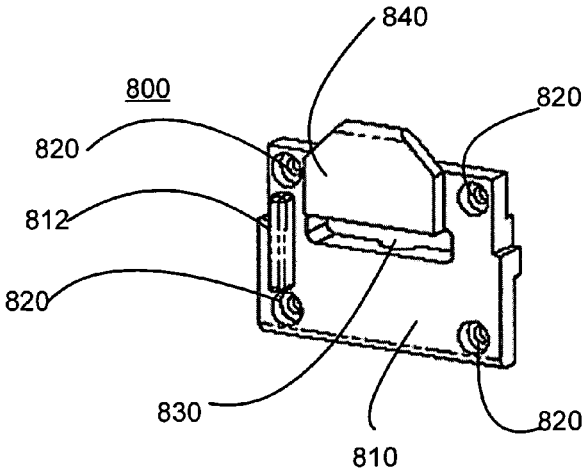
FIGS. 8(*a*) and (*b*) are front and back perspective views of an engagement plate of a test adapter in accordance with an alternative embodiment of the present invention.
Figure 8B:
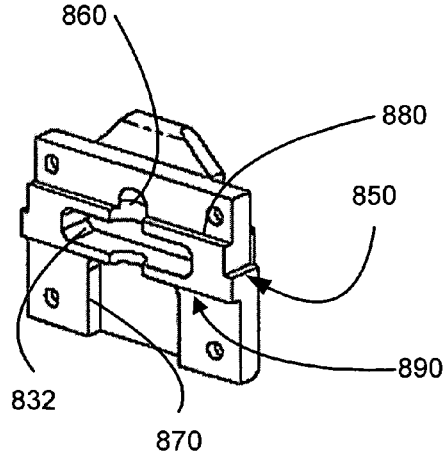

An alternative embodiment of the engagement plate will be described with reference to FIGS. 8(*a*) and (*b*). The engagement plate 800 has four spaced apart screw holes 820 for mounting the engagement plate to the side 240 of the test adapter frame 210. While four screw holes 820 in this embodiment are located near four corners of the engagement plate, other numbers of mounting screw holes, locations for such screw holes, and mounting arrangement will be apparent to those of skill in the art and may be used with the present invention.

The engagement plate 800 further has an engagement slot 830 for receiving the camming arms 642 of the engagement lever 600 during engagement of a test adapter 200 into a receiver 100. In this preferred embodiment, the engagement slot is elongated and has beveled corners 832. Other shapes and structures of an engagement slot will be apparent to those of skill in the art and may be used in the invention. The engagement slot provides an engagement surface onto which the camming arms of the engagement lever exert force to pull or push the test adapter into the receiver. The engagement slot further provides a disengagement surface onto which the camming arms of the engagement lever 600 exert force to disengage the test adapter from the receiver. Thus, the slot serves both engagement and disengagement purposes in this embodiment.

Further, while an engagement plate and slot are used in this embodiment, other embodiments in which an engagement surface of some type other than a slot may be used. For example, an engagement surface could be machined into the side of the test adapter frame 210 as an engagement member.

At the top and bottom of the engagement slot 830 are arched portions 860, 870. The arched portions 860, 870 align with an arched portion (not shown) formed in the test adapter frame 210 to form an alignment hole through which the tooling pins 190 protrude from the face of the receiver prior to and during engagement. The engagement plate 800 further has a polarizing ridge 812 protruding therefrom for polarizing the engagement plate 800 with the rotation block 700 during engagement.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. An interface device comprising:

a receiver comprising:

a receiver frame comprising first and second pairs of opposing sides;

a first mounting member on a first side of said first pair of opposing sides of said receiver frame and a second mounting member on a second side of said first pair of opposing sides;

a first engagement lever mounted to said first mounting member and a second engagement lever mounted to said second mounting member for drawing a test adapter into engagement with said receiver, each said engagement lever comprising a pair of spaced engagement members; and the test adapter comprising:

a test adapter frame comprising two pairs of opposing sides; and an engagement surface on each of one pair of opposing sides of said test adapter frame;

wherein during engagement of said test adapter into said receiver, a pair of said engagement members on at least one of said engagement levers simultaneously exert a force on an engagement surface of said test adapter.

2. An interface device according to claim 1 wherein said engagement lever further comprises:

a body having a first and second ends and first and second sides, said spaced engagement members being located on said first side near said first end;

a connection member for connecting said engagement lever to a rotation member, said connection member being located on said second side near said first end.

3. An interface device according to claim 1 wherein said receiver frame further comprises an alignment pin near at least one rotation member; and said test adapter frame further comprises means for receiving said alignment pin.

4. An interface device according to claim 3 wherein said alignment pin comprises a polarized tooling pin.

5. An interface device according to claim 1 wherein said receiver further comprises:

a module mounted to said receiver frame; and a floating contact mounted to said module.

6. An interface device according to claim 5 wherein said test adapter further comprises:

a second module mounted to said test adapter frame; and a floating contact mounted to said second module.

7. An interface device according to claim 1 wherein each of said engagement levers is rotationally mounted to one of said mounting members.

8. An interface device according to claim 7 wherein said test adapter further comprises a pre-engagement portion for contacting at least one of said engagement members and causing rotation of said engagement lever to which said engagement member is connected prior to said engagement lever exerting a force on said engagement surface of said test adapter.

9. An interface device according to claim 1 wherein, said engagement lever member further comprises a latch for locking said lever in a closed position.

10. An interface device according to claim 9 wherein said test adapter further comprises a latch plate onto which said latch connects to secure said engagement lever in a closed position.

11. An interface device according to claim 9 wherein said receiver further comprises a latch member onto which said latch connects to secure said engagement lever in a closed position.

12. An interface device according to claim 9 wherein said mounting member further comprises a latch member onto which said latch connects to secure said engagement lever in a closed position.

13. An interface device according to claim 12 wherein said latch member comprises a dowel.

14. An interface comprising:

a receiver comprising:

a receiver frame comprising first and second pairs of opposing sides;

a pair of rotation blocks, wherein one of said pair of rotation blocks is mounted to each of one pair of opposing sides of said receiver frame;

an engagement lever mounted to each of said rotation blocks, each said engagement lever comprising:

a lever body having first and second ends and first and second sides;

a pair of spaced engagement arms on a first side of said lever body near said first end of said lever body; and means for mounting said engagement lever to said rotation block; and a test adapter comprising:

a test adapter frame comprising two pairs of opposing sides; and an engagement plate mounted to each of one pair of opposing sides of said test adapter frame, each said engagement plate comprising:

an engagement plate body;

a plurality of mounting holes in said engagement plate body for mounting said engagement plate body to said test adapter frame; and an engagement slot in said engagement plate body;

wherein during engagement of said test adapter into said receiver, at least one pair of said engagement arms align with and exert a force on a surface of an engagement slot of said test adapter to draw said test adapter into engagement with said receiver.

15. An interface according to claim 14 wherein at least one of said rotation blocks further comprises an alignment groove and at least one of said engagement plates further comprises an alignment ridge; wherein said alignment ridge enters said alignment groove when said test adapter is engaged in said receiver.

16. An interface according to claim 14 wherein said engagement plate further comprises a latch plate and said engagement lever further comprises a latch, and wherein said latch locks said test adapter into said receiver after engagement.

17. An interface according to claim 14 wherein said rotation block further comprises a plurality of mounting holes for mounting said rotation block to said receiver frame.

18. An interface according to claim 14 wherein said engagement lever body is contoured.

19. An interface comprising:

a receiver comprising:

a receiver frame comprising two pairs of opposing sides;

a pair of engagement levers, each said engagement lever having dual camming surfaces; and means for mounting each of said engagement levers to a side of said receiver frame; and a test adapter comprising:

a test adapter frame comprising first and second pairs of opposing sides; and means on each of said first pair of sides of said test adapter frame for engaging with said dual camming surfaces of one of said engagement levers;

wherein during engagement of said test adapter into said receiver, said dual camming surfaces of at least one of said engagement levers align with and exert a force on at least one of said means for engaging of said test adapter to draw said test adapter into engagement with said receiver.

* * * * *